US006351877B1

(12) United States Patent
Harris et al.

(10) Patent No.: US 6,351,877 B1
(45) Date of Patent: Mar. 5, 2002

(54) SYNTHETIC FIBER CRIMPER, METHOD OF CRIMPING AND CRIMPED FIBER PRODUCED THEREFROM

(75) Inventors: James E. Harris; Timothy Lee Chae; Jesse Newton Cannon; William Andrew Crow, all of Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 6 days.

(21) Appl. No.: 09/583,768

(22) Filed: May 31, 2000

(51) Int. Cl.[7] ..... D02G 1/12
(52) U.S. Cl. ..... 28/263; 28/269
(58) Field of Search ..... 28/247, 248, 250, 28/262, 263, 264, 267, 268, 269, 270; 57/245, 246; 428/362, 369

(56) References Cited

U.S. PATENT DOCUMENTS 3,090,096 A * 5/1963 Schwartz ..... 28/264
3,120,692 A 2/1964 Crawford et al.
3,137,055 A 6/1964 Rainard et al.
3,160,923 A 12/1964 Rainard et al.

(List continued on next page.)

FOREIGN PATENT DOCUMENTS

GB 1 415 655 11/1975
GB 1 534 587 12/1978

*Primary Examiner*—Amy B. Vanatta
(74) *Attorney, Agent, or Firm*—Cheryl J. Tubach; Bernard J. Graves, Jr.

(57) ABSTRACT

The crimper has a pair of feed rollers to supply fiber traveling therebetween. The feed rollers rotate at a first speed. A pair of outlet rollers receive fiber from the feed rollers and rotate at a second speed slower than the first speed. A pair of side walls sandwich the feed rollers and the outlet rollers. A pair of floating scrapers are supported by move with the feed rollers, the outlet rollers and the side walls. Fluid is supplied to and ejected from the scrapers such that a fluid bearing is created at least between the scrapers and the feed rollers. There are two pairs of outlet rollers with a belt rotating about each pair of outlet rollers. For each pair, a first of the outlet rollers is adjacent to the scraper and a second of the outlet rollers is displaced from the scraper. A space between the scrapers defines a crimping chamber. The first outlet rollers are moved toward and away from one another, thereby causing the crimping chamber to open and close. To move the first outlet rollers, a hydraulic positioning unit selectively supplies fluid to opposite ends of the first outlet rollers with the pressure of the fluid supplied to the opposite ends being equalized. Equalized hydraulic biasing force is also used to bias the first outlet rollers toward the scrapers and to bias the feed rollers toward one another and toward the scrapers. Fiber produced by this method and with this device has superior crimp uniformity.

33 Claims, 10 Drawing Sheets

U.S. PATENT DOCUMENTS

| | | | | | |
|---|---|---|---|---|---|
| 3,160,941 | A | * | 12/1964 | Williamson | 28/267 |
| 3,528,149 | A | | 9/1970 | Tambini et al. | |
| 3,636,149 | A | * | 1/1972 | Tambini | 28/269 |
| 3,679,533 | A | * | 7/1972 | Fukuda et al. | 28/263 |
| 3,798,718 | A | * | 3/1974 | Trifunovic | 28/264 |
| 3,859,695 | A | | 1/1975 | Erickson | |
| 3,924,911 | A | | 12/1975 | Bumberger | |
| 3,936,917 | A | | 2/1976 | Vermeer et al. | |
| 3,938,226 | A | * | 2/1976 | Roberts | 28/263 |
| 4,019,788 | A | | 4/1977 | Buchalla | |
| 4,067,092 | A | * | 1/1978 | Roberts | 28/264 |
| 4,075,743 | A | | 2/1978 | Roberts | |
| 4,258,457 | A | * | 3/1981 | Hughes et al. | 28/267 |
| 4,270,252 | A | | 6/1981 | Harrison et al. | |
| 4,315,355 | A | * | 2/1982 | Stanley | 28/267 |
| 4,395,804 | A | | 8/1983 | Saxon et al. | |
| 4,503,593 | A | | 3/1985 | Floyd et al. | |
| 4,521,944 | A | | 6/1985 | Stockbridge | |
| 4,547,934 | A | | 10/1985 | Ford | |
| 4,589,173 | A | | 5/1986 | Fleissner | |
| 4,662,042 | A | | 5/1987 | Bayliss, Sr. | |
| 4,707,896 | A | | 11/1987 | Sowell | |
| 4,807,337 | A | | 2/1989 | Fleissner | |
| 4,854,021 | A | | 8/1989 | Reinehr et al. | |
| 5,025,538 | A | * | 6/1991 | Saleh | 28/263 |
| 5,074,016 | A | * | 12/1991 | Meyer | 28/263 |
| 5,105,513 | A | | 4/1992 | Marx et al. | |
| 5,485,662 | A | * | 1/1996 | Hodges Jr. et al. | 28/267 |
| 5,564,174 | A | | 10/1996 | Rovellini et al. | |
| 5,778,502 | A | * | 7/1998 | Voigtlander et al. | 28/269 |

* cited by examiner

SYNTHETIC FIBER CRIMPER, METHOD OF CRIMPING AND CRIMPED FIBER PRODUCED THEREFROM

BACKGROUND OF THE INVENTION

1. Field of the Invention

The present invention relates generally to the production of synthetic crimped fiber. More specifically, the present invention relates to a self-aligning, self-adjusting controlled discharge crimper, the method of operation thereof, and the fiber produced thereby.

2. Description of the Related Art

Synthetic textile fibers and cellulose acetate tow are typically manufactured from a continuous, multifilament bundle of fibers, which has been crimped using stuffer box crimper technology. FIG. 1 is a side view of a conventional stuffer box crimper. This device was first described in U.S. Pat. No. 3,120,692. A pair of driven feed rollers 1 deliver a multifilament band of uncrimped tow 2. A pair of scrapers 3 are fitted very close to the feed rollers 1 so as to prevent tow 2 from entering between the rollers 1 and the scrapers 3. Cheek plates (not shown in FIG. 1) are provided on either side of the feed rollers 1 and the scrapers 3 and fitted closely adjacent thereto. The cheek plates, together with the scrapers 3, form a crimping chamber. Moving fiber 2 is frictionally constrained within the chamber with a clapper 4. Air pressure biases the clapper 4 in a direction that closes the chamber. The fiber bends and buckles within the chamber causing the fiber to crimp. The crimped fiber applies pressure to the clapper 4 opposing the biasing force for the air pressure. As more fiber builds up in the chamber, the pressure increases. After some threshold, the clapper 4 opens allowing fiber to exit the chamber. The crimped fiber builds up quickly within the chamber. The resulting quick opening and closing of the clapper 4 causes a chattering effect.

The diameter of the fibers being crimped is frequently less than 0.0008 inches, and it is very easy for the fibers to catch between the driven feed rollers 1 and the scrapers 3. To prevent this from occurring, the scrapers 3 must be precisely positioned at a minimum space from the driven feed rollers 1. Scrapers 3 are positioned manually, however, and significant time and know how are required to do the job properly.

Fiber 2 can also get caught between the cheek plates and the driven feed rollers 1. To prevent this from happening, the driven feed rollers 1 must be precisely aligned with one another so that the ends of the feed rollers 1 are in precisely the same plane. Aligning the feed rollers 1 of the conventional device also requires manual control. If the feed rollers 1 are not properly aligned, the cheek plates are not evenly supported against them. One side of each roll may experience excess friction and the other side may experience a loose fit. On the excess friction side heat and wear can be problematic. On the loose fit side, the fiber can get caught.

Crimped fiber purchasers have placed increased emphasis on crimp uniformity. With the device shown in FIG. 1, the amount of crimp is affected by the movement of the clapper 4. As the chamber fills with crimped fiber, the amount of crimp given to the fiber increases. When the force of the fiber in the chamber is sufficient to open the clapper 4, fiber is allowed to escape freely until clapper 4 closes. During the interim, while the clapper 4 is open, little or no crimp is being imparted to the fiber 2. Within the crimping chamber there is inadequate control of the ratio of fiber inlet velocity to fiber outlet velocity. This produces a fiber having inconsistent crimp.

A review of the prior art related to stuffer box crimpers indicates that since their inception, there has been little change in the basic operating principles of these devices, with the exception of minor mechanical modifications. This not only holds true for acetate tow crimping, but also for the crimping of textile fiber tows in general. For example, U.S. Pat. No. 4,521,944 describes a dowel aligned multiple crimper to improve alignment of crimper components. This crimper, however, does not deviate in basic operating principle from conventional stuffer box crimper designs.

U.S. Pat. Nos. 3,924,911; 4,019,788; 4,395,804; 4,589,173; 4,662,042; 4,807,337 and 5,105,513 describe various methods of reducing cheek plate wear through modified cheek plate mounting means as well as improved lubricating means.

U.S. Pat. Nos. 3,528,149; 3,859,695; 3,936,917; 4,270,252; 4,503,593; 4,547,934; 4,707,896 and 4,854,021 describe various modifications and means of controlling clapper gates, but again the basic principle of operation of the stuffer box crimper is not modified. U.S. Pat. No. 3,160,923 diverges from conventional stuffer box concepts in that it utilizes conveyer belts in place of clappers. However, this crimper would be unacceptable for crimping flat, multifilament tow bands since it utilizes a tubular crimping chamber that would only be acceptable for crimping individual yarn strands. The conveyer belts in this patent are also rigidly positioned and are described as converging toward each other to form a progressively tapered compacting zone. Such a converging compaction zone would be detrimental to flat, crimped, multifilament tow bands.

U.S. Pat. No. 3,798,718 also uses conveyer belts. However, these belts are placed parallel to the nip of the input feed rolls and perpendicular to the direction of the inlet fiber path. This type of arrangement could not be utilized to crimp flat, multifilament tow bands and would be useful only for crimping individual yarn strands.

U.S. Pat. No. 3,137,055 describes a stuffer box type of crimper for yarn or tow (but the device really appears to be designed for yarns) that uses a pair of wheels, which extend normal to the axes of the feed rolls and extend peripherally into the crimping chamber adjacent the bite of the feed rolls to form a constriction in the chamber for retarding to a controlled extent the passage of the mass of packed fibers, and thereby maintaining a controlled crimping pressure. Experience has shown that the use of driven wheels of this type are not optimal for controlling the discharge rate of tow because of slippage that occurs between the fiber and the wheels. Constricting wheels of this type also compact and distort the crimp whose improved uniformity is the object of the invention.

SUMMARY OF THE INVENTION

Accordingly, it is an object of the present invention to avoid manual alignment of scrapers with driven feed rollers.

It is a further object of the present invention to provide a device that has a constant ratio of inlet fiber velocity to outlet fiber velocity.

It is another object of the present invention to provide a very close scraper/feed roller fit.

It is yet another object of the present invention to produce synthetic fibers having improved crimp uniformity.

It is still another object of the present invention to provide a device that maintains alignment of feed rollers and other parts while minimizing manual manipulation.

These and other objects are accomplished by providing a crimper having a pair of feed rollers to supply fiber traveling therebetween. The feed rollers rotate at a first speed. A pair of outlet rollers receive fiber from the feed rollers and rotate at a second speed, slower than the first speed. A pair of side walls sandwich the feed rollers and the outlet rollers. A pair of floating scrapers are supported by and move with, the feed rollers, the outlet rollers and the side walls. Fluid is supplied to and ejected from the scrapers such that a fluid bearing is created at least between the scrapers and the feed rollers.

There are two pairs of outlet rollers with a belt rotating about each pair. For each pair, a first of the outlet rollers is adjacent to the scraper and a second of the outlet rollers is displaced from the scraper. A space between the two scrapers defines a crimping chamber. The first outlet rollers are moved toward and away from one another, thereby causing the crimping chamber to open and close.

To move the first outlet rollers, a hydraulic positioning unit selectively supplies fluid to opposite ends of each first outlet roller with the pressure of the fluid supplied to the opposite ends being equalized. Equalized hydraulic biasing force is also used to bias the first outlet rollers toward the scrapers and to bias the feed rollers toward one another and toward the scrapers. Fiber produced by this method and with this device has superior crimp uniformity.

A self-aligning mechanism correctly positions the feed rollers and the first and second outlet rollers about three mutually perpendicular axes. For the first outlet rollers, the self-aligning mechanism includes a pair of side walls sandwiching the first outlet rollers to position them along a first axis. For the second axis of the first outlet rollers there are a pair of pivotal bearings, two pairs of arms and a pair of biasing devices. Each arm has inner and outer ends and a central portion. The central portion of each pair of arms rotates about one of the pivotal bearings. The inner ends of each pair connect with one of the first outlet rollers to control the position of the first outlet roller along the second axis. Each biasing device is connected to the outer ends of one pair of arms. For the third axis of the first outlet rollers, there are a pair of air springs and two pairs of hydraulic cylinders. Each air spring is connected to one of the first outlet rollers. Each pair of hydraulic cylinders is connected to one of the first outlet rollers to selectively bias the first outlet roller against a force from one of the air springs, to thereby control the position of the first outlet roller along the third axis. Each pair of hydraulic cylinders is in fluid communication.

For the feed rollers, the self-aligning mechanism uses the pair of side walls to sandwich the feed rollers to position them along the first axis. For the second axis of the feed rollers, there are two pairs of hydraulic reference cylinders, each pair being connected to one of the feed rollers to control the position of the feed roller along the second axis. Each pair of hydraulic reference cylinders is in fluid communication. For the third axis of the feed rollers there are a pair of pivotal bearings, two pairs of loading arms and a pair of hydraulic loading cylinders. Each loading arm has first and second ends and a central portion. The central portions of each pair of loading arms rotate about one of the pivotal bearings. The first ends of each pair connect with one of the feed rollers to control the position of the feed roller along the third axis. Each hydraulic loading cylinder is connected to the second ends of one pair of loading arms.

BRIEF DESCRIPTION OF THE DRAWINGS

The invention will be readily understood by reference to the following description of preferred embodiments described by way of example only, with reference to the accompanying drawings in which like reference characters represent like elements, wherein.

DETAILED DESCRIPTION OF THE PREFERRED EMBODIMENTS

Figure 1:
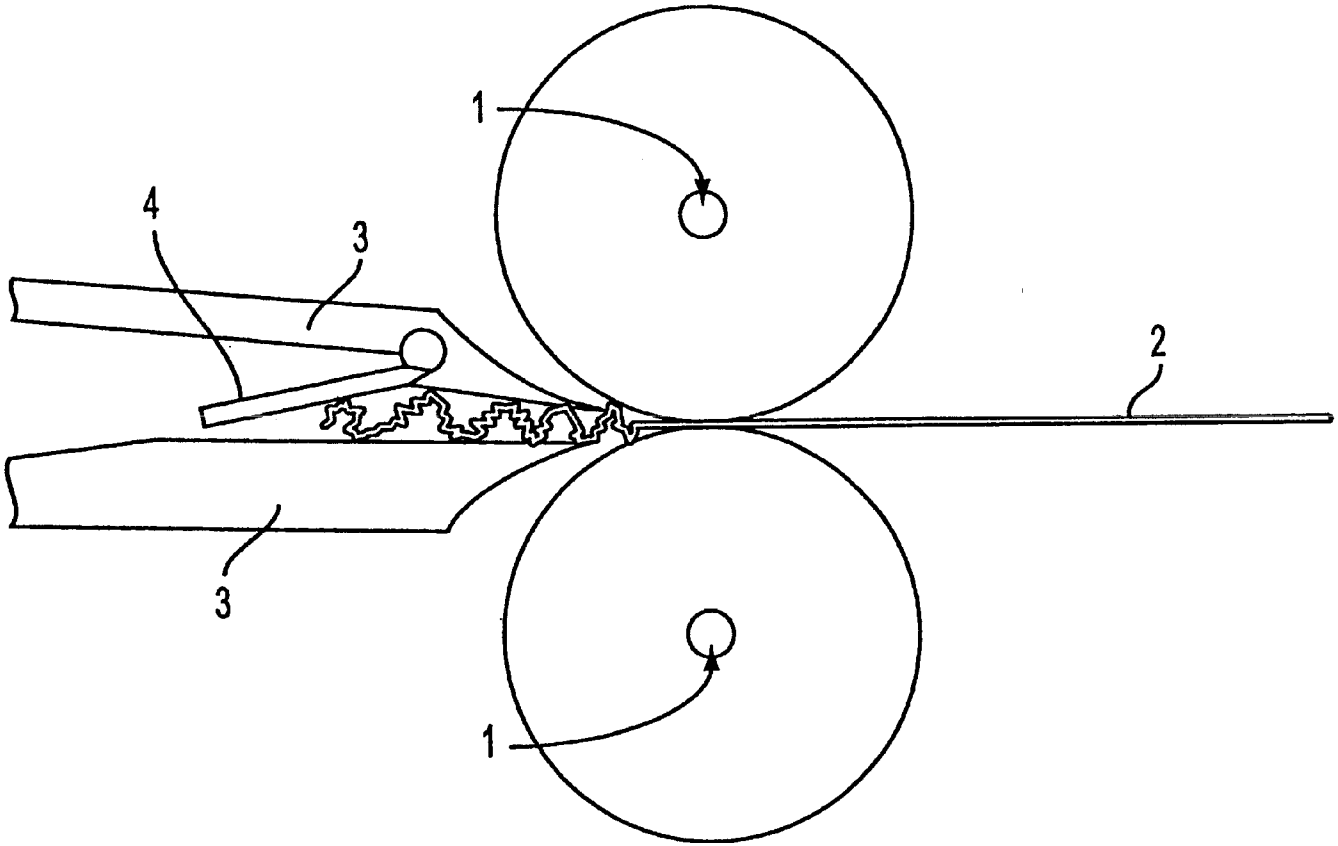
FIG. 1 (PRIOR ART)
FIG. 1 is a side view of a conventional stuffer box crimper.
Figure 2:
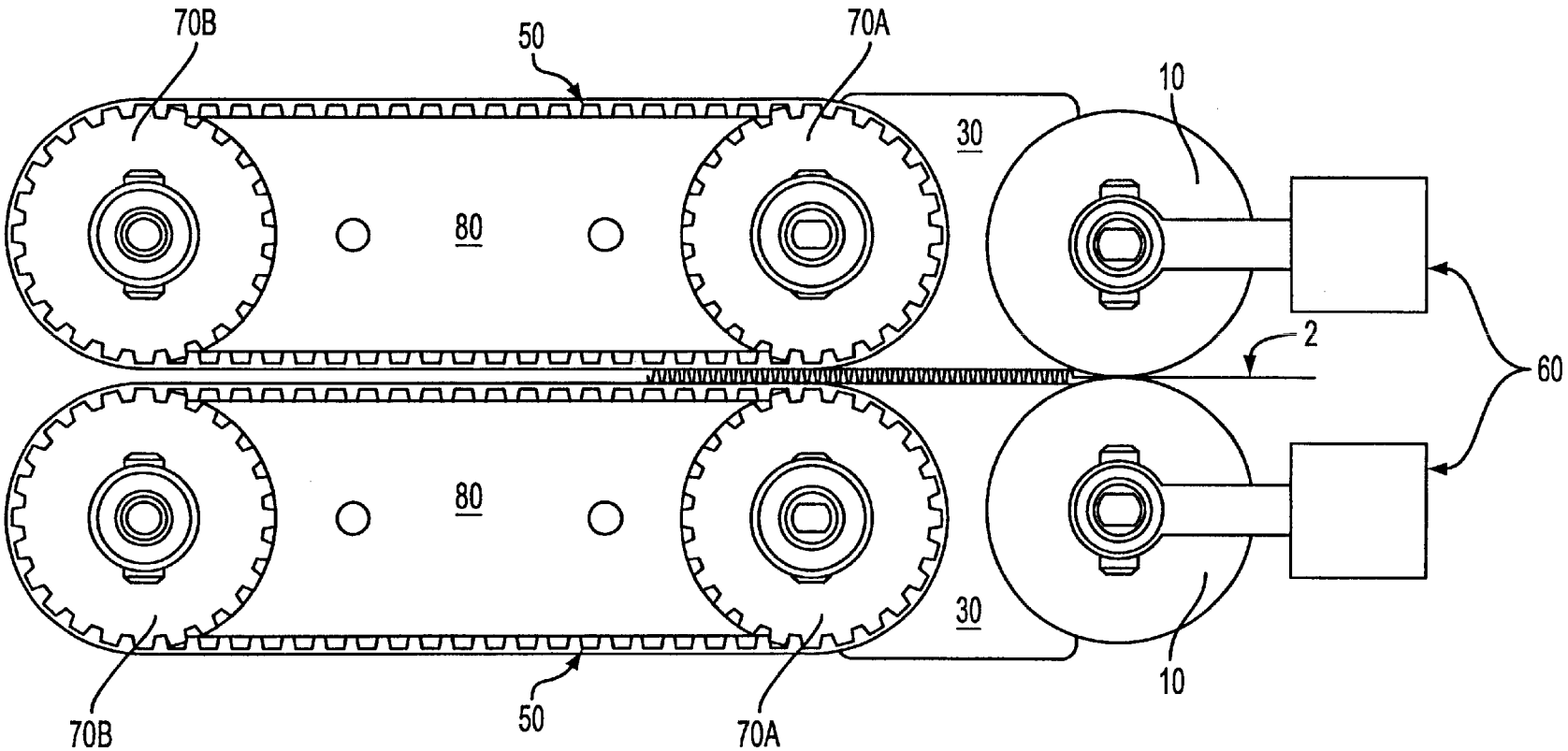
FIG. 2 is a schematic view of a fiber crimper according to the present invention.

FIG. 2 is a schematic view of a fiber crimper according to the present invention. A multifilament bundle of fibers 2 is pulled into the device through a nip between two driven feed rollers 10. The driven feed rollers 10 are pressurized hydraulically against each other. Fibers 2 are drawn out of the crimper at a constant speed with timing belts 50. The upper timing belt 50 is rotated in a clockwise direction. The lower timing belt 50 is rotated in a counter clockwise direction. A pair of scrapers 30 fit between the driven feed rollers 10 and the timing belt 50. A water oil emulsion is injected into the scrapers 30. Flow channels direct the emulsion to the sides of the scrapers 30 facing the driven feed roller 10 and the timing belt 50. Hydraulic cylinders 60 the bias feed rollers 10 toward the scrapers 30 such that only a thin film of fluid separates the driven feed rollers 10 and the scrapers 30. From the fiber exit side, manually adjusted screws (not shown) oppose the force of the hydraulic cylinders 60. As can be seen from FIG. 2, each timing belt 50 rotates about a pair of belt rollers 70*a*, 70*b*. The belt rollers 70*a* adjacent to the scrapers 30 are driven belt rollers, and the rollers 70*b* displaced from the scrapers 30 are idler belt rollers. A pair of shoes 80 support the timing belts 50 as they rotate about the belt rollers 70*a* and 70*b*. Comparing FIGS. 1 and 2, the timing belts replace the clapper mechanism of the conventional device. The crimping chamber is defined by the space between the scrapers 30.

Figure 3:
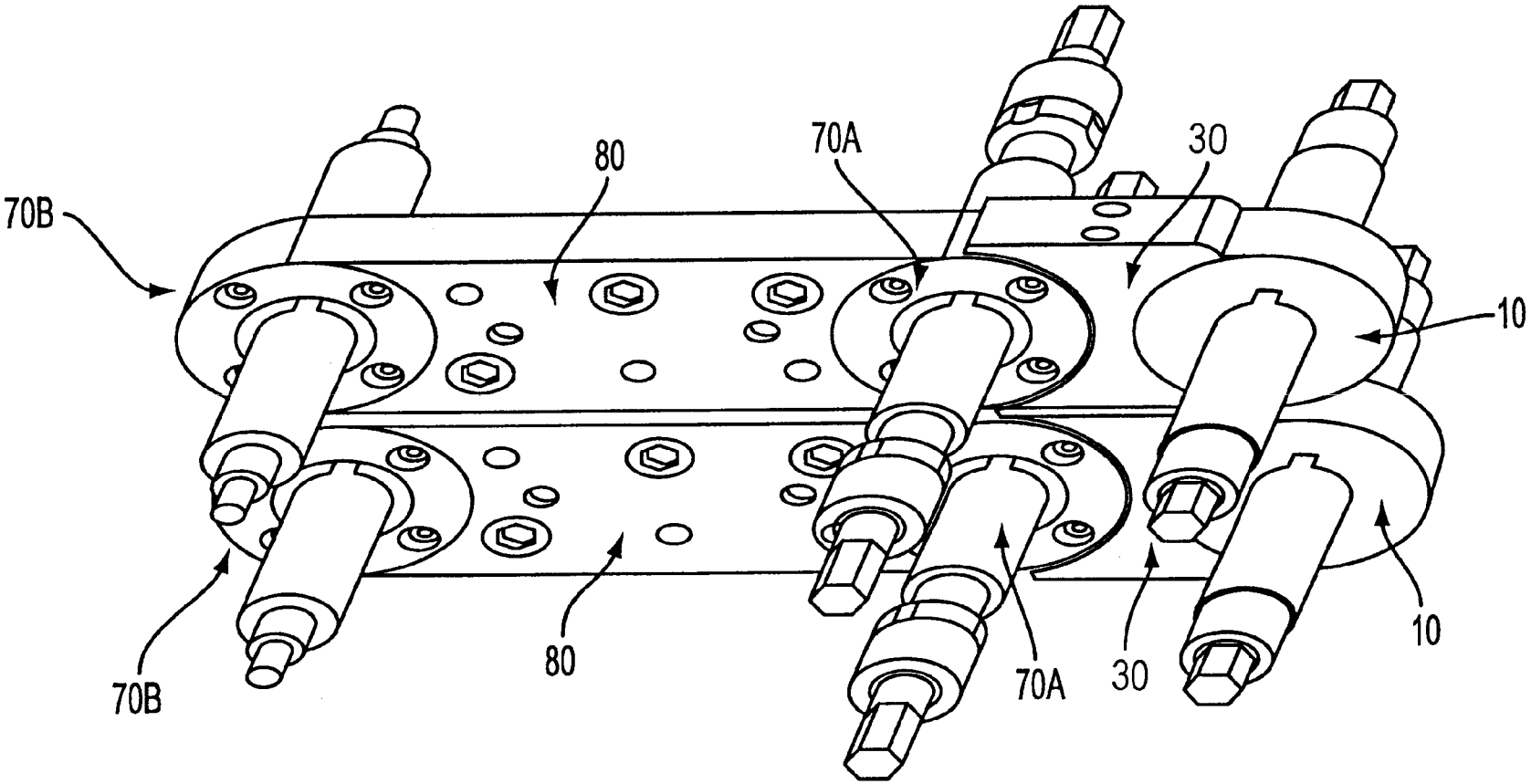
FIG. 3 is a perspective view of the crimper shown schematically in FIG. 2.
Figure 4A:
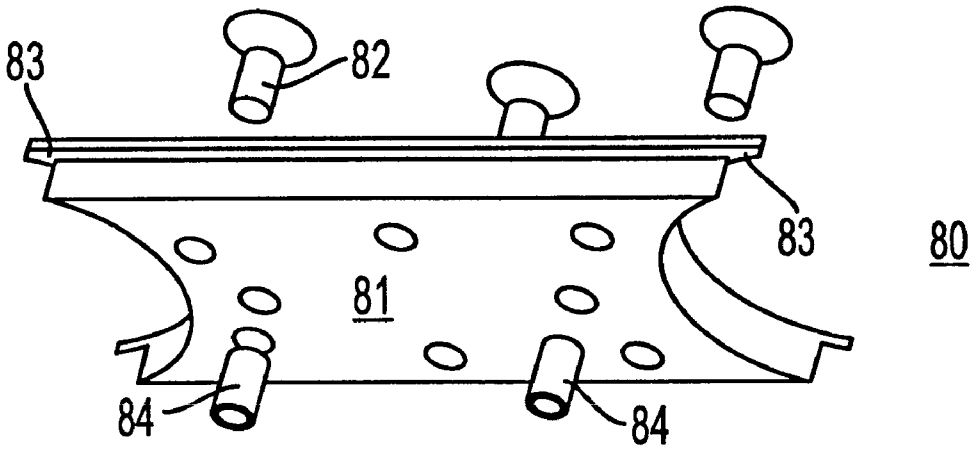
FIGS. 4A and 4B are exploded perspective views of a shoe shown in FIGS. 2 and 3.
Figure 4B:
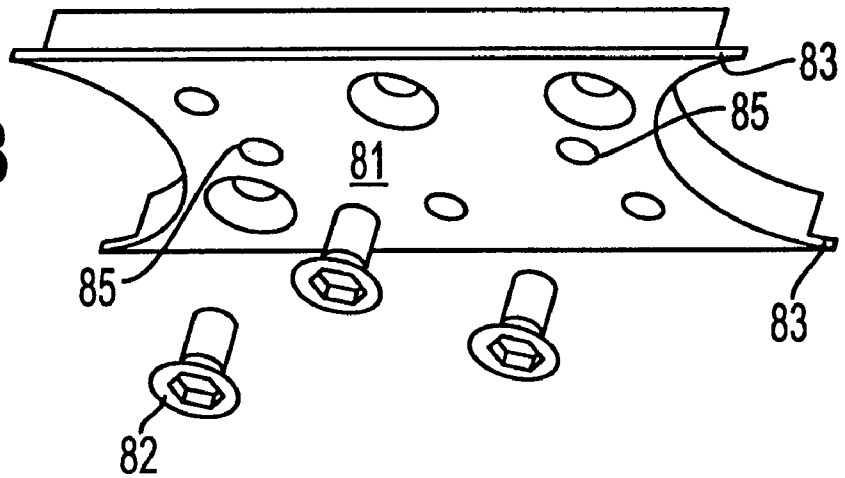

FIG. 3 is a perspective view of the crimper shown schematically in FIG. 2. The timing belts 50, which may be formed of neoprene, are not shown in FIG. 3. FIG. 4 is an exploded perspective views of a shoe 80 shown in FIGS. 2 and 3. As can be seen, each shoe is formed from a pair of disks 81. The disks 81 may be formed of nylon. The disks 81 are held together using screws 82. Each disk 81 may have lips 83 formed at the edges thereof. Lips 83 are included in the shoes 80 shown in FIGS. 4A and 4B, but not in the shoes 80 shown in FIG. 3. When shoes 80 are assembled, the lips 83 may form a track on which the timing belts 50 are guided. Dowel pins 84 may extend into holes 85 in the disks 81 to aid in aligning the disks 81 before the disks 81 are assembled into the crimper.

Figure 5A:
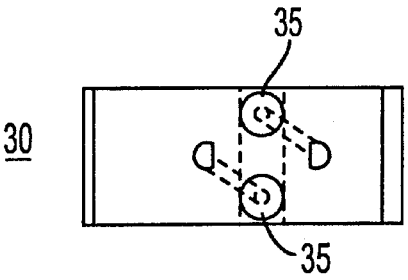
FIG. 5A is a top view of a scraper shown in FIGS. 2 and 3.
Figure 5B:
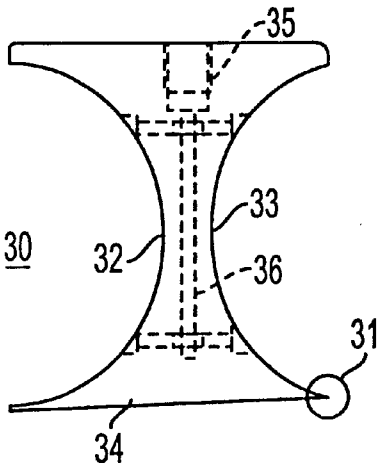
FIG. 5B is a side view of the scrapers shown in FIGS. 2 and 3.

FIG. 5*a* is a top view of a scraper 30 shown in FIGS. 2 and 3. FIG. 5B is a side view of the scraper 30 shown in FIGS. 2 and 3. As can be seen, scraper 30 comes to a relatively sharp point 31, which fits near the nip between the driven belt rollers 10. Front side 33 faces the driven feed roller 10. Back side 32 faces the timing belt 50 as it rides on the driven belt roller 70*a*. Bottom side 34 defines the crimping chamber. Bottom side 34 is provided with a slight taper so that the crimping chamber opens slightly from the inlet to the outlet thereof. Fluid is injected through upper ports 35 provided in the scraper 30. The fluid travels from the upper ports 35 down through center channels 36 to be ejected from the front and back sides 32, 33 of the scraper 30. With fluid injection into the space between the scrapers 30 and the driven feed rollers 10, a fluid bearing is provided. This allows for the space between these two elements to be very small.

Figure 6:
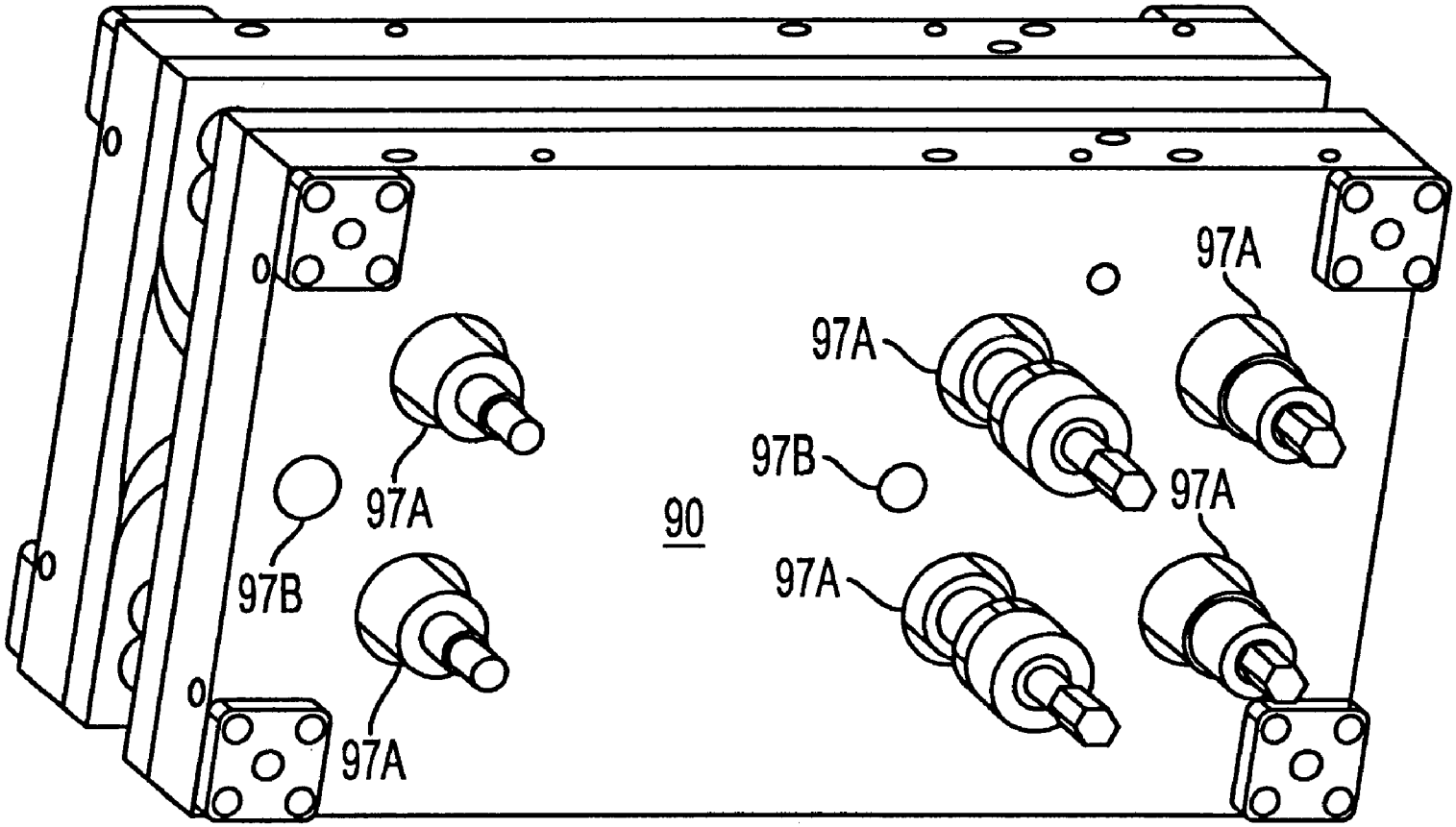
FIG. 6 is a perspective view of the crimper shown in FIGS. 2 and 3, with side plates attached thereto.
Figure 7:
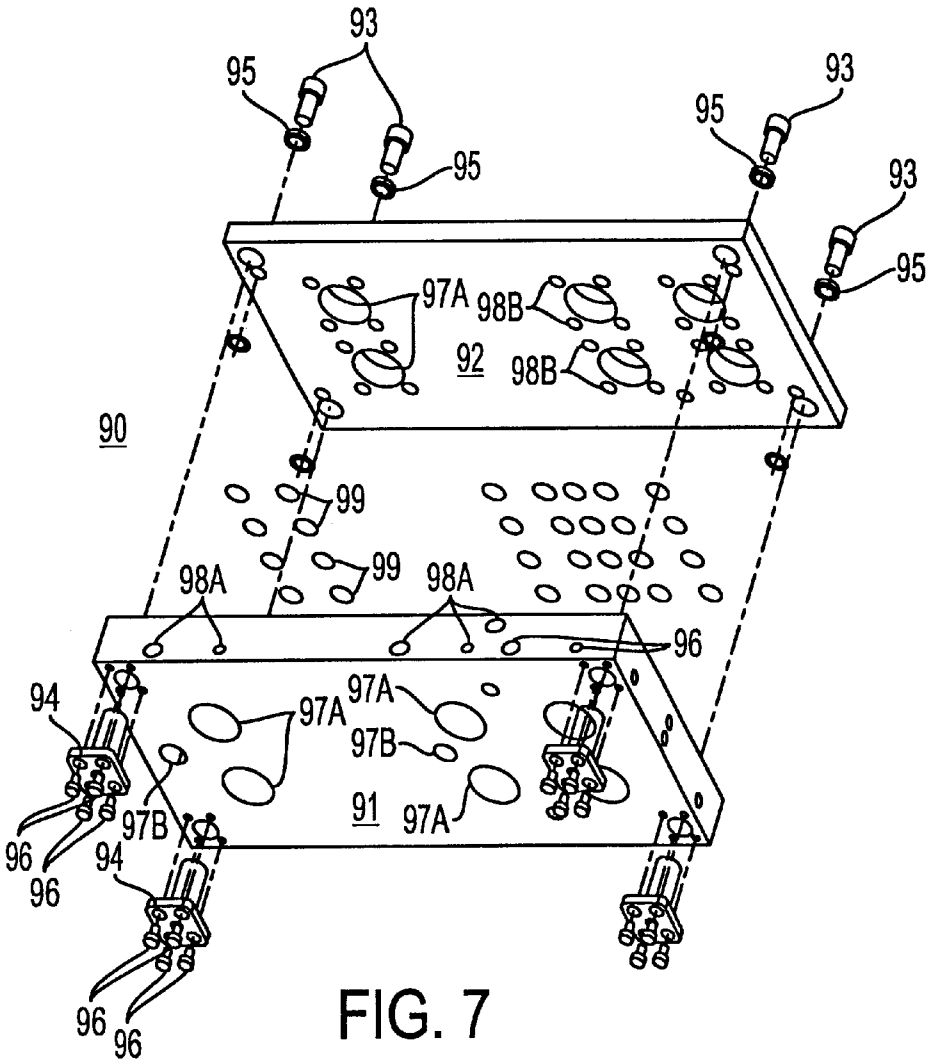
FIG. 7 is an exploded perspective view of one side plate.

As mentioned previously, side plates are provided on either side of the assembly shown in FIGS. 2 and 3 to retain the fiber within the assembly. FIG. 6 is a perspective view of the crimper shown in FIG. 3, with side plates 90 attached thereto. FIG. 7 is an exploded perspective view of one side plate 90. Each side plate 90 is formed of a metal portion 91 and ceramic portion 92. The ceramic portion 92 faces the assembly shown in FIG. 3. The two portions 91, 92 of the side plate 90 are bolted together with bolts 93 through washers 95.

Caps 94 are each attached to the metal portion 91 with bolts 96. A linear bearing is provided in each cap 94. A pin (not shown) is received in each linear bearing. The pin extends from one side plate 90 to the opposing side plate 90. See FIG. 9. The pin keeps the plates 90 from rotating with respect to one another.

Fluid is injected into injection ports 98A provided in metal portion 91. Six through holes 97*a* are provided for the shafts of rollers 10, 70*a*, 70*b* of the crimper assembly. Fluid is guided from the injection ports 98A down through the metal portion 91 and then to the ceramic portion 92. The fluid traverses from the metal portion 91 to the ceramic portion 92 via fluid ports 98B provided at corresponding positions in both the metal and ceramic portions 91, 92. O-rings 99 seal the fluid ports 98B between the metal portion 91 and the ceramic portion 92. From the ceramic portion, the fluid is ejected in the vicinity of each of the six through holes 97*a* via fluid ports 98B. As can be seen, four fluid ports 98B are provided for each through hole 97*a*.

The thin film of fluid from the scrapers 30 and side walls 90 provides hydrostatic support and separation of crimper components. When the crimper is operated at normal speeds, both hydrostatic and hydrodynamic support is provided. The end result of using injected fluid films and self alignment of component parts is precise alignment of crimper parts, accurate control of crimper clearances, low frictional drag between crimper components, and reduced crimper component wear.

To secure side plates 90 to the assembly shown in FIG. 3, alignment pins are received in holes 97*b*, which alignment pins bias the side plates 90 towards one another. Note that holes 97*b* are not provided in the ceramic portion 92. Further, holes 97*b* extend only partially through metal portion 91. Thus, the alignment pins rest against the bottoms of hole 97*b* in the metal portion 91. The alignment pins support the side plates 90 at their center of gravity and are loaded normal to the plane in which plates 90 lie. In addition to holding the crimper assembly together, when the normal loading of the side plates 90 is combined with the mechanical and horizontal hydraulic positioning of the rolls, all parts of the crimper are forced into proper alignment.

Figure 8:
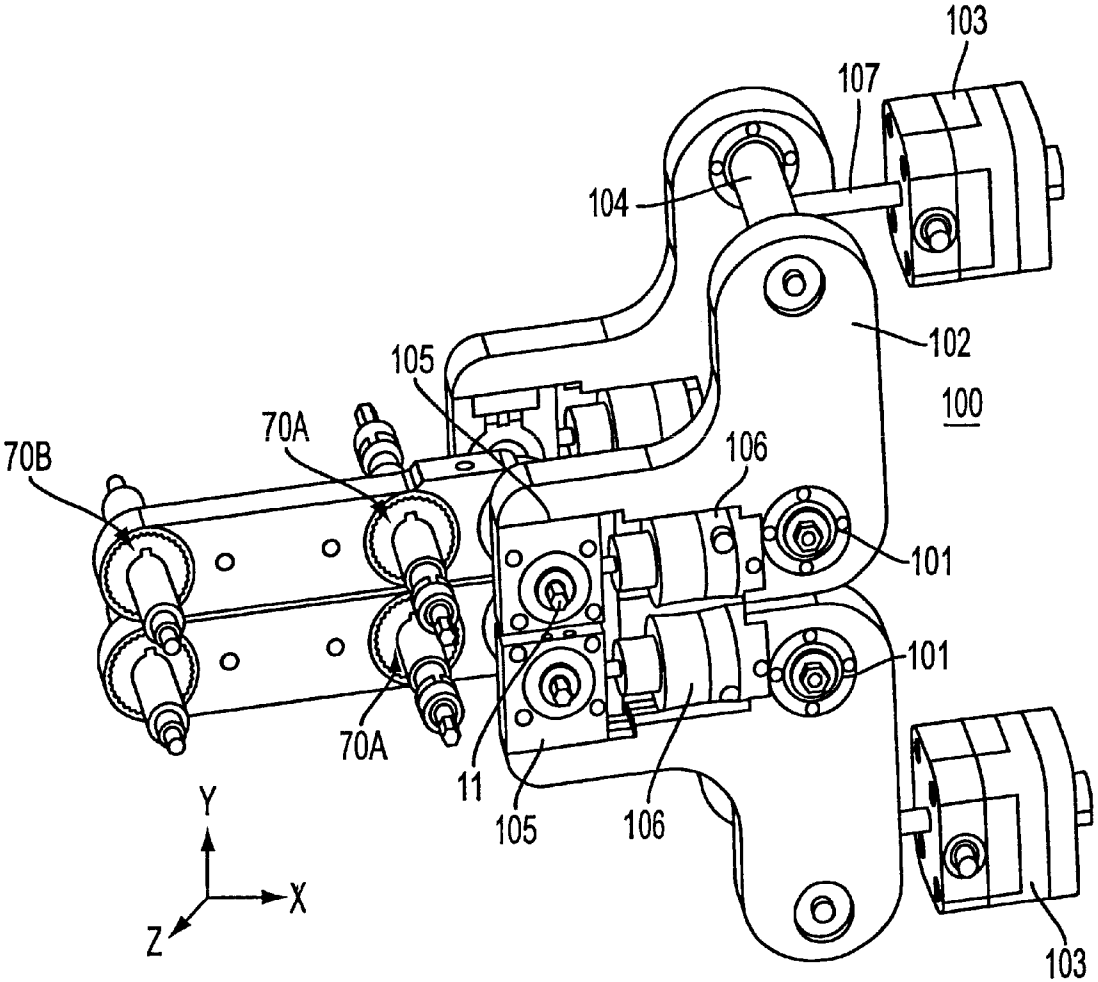
FIG. 8 is a perspective view of the crimper shown in FIGS. 2 and 3, with a loading system, but not the side plates attached.
Figure 9:
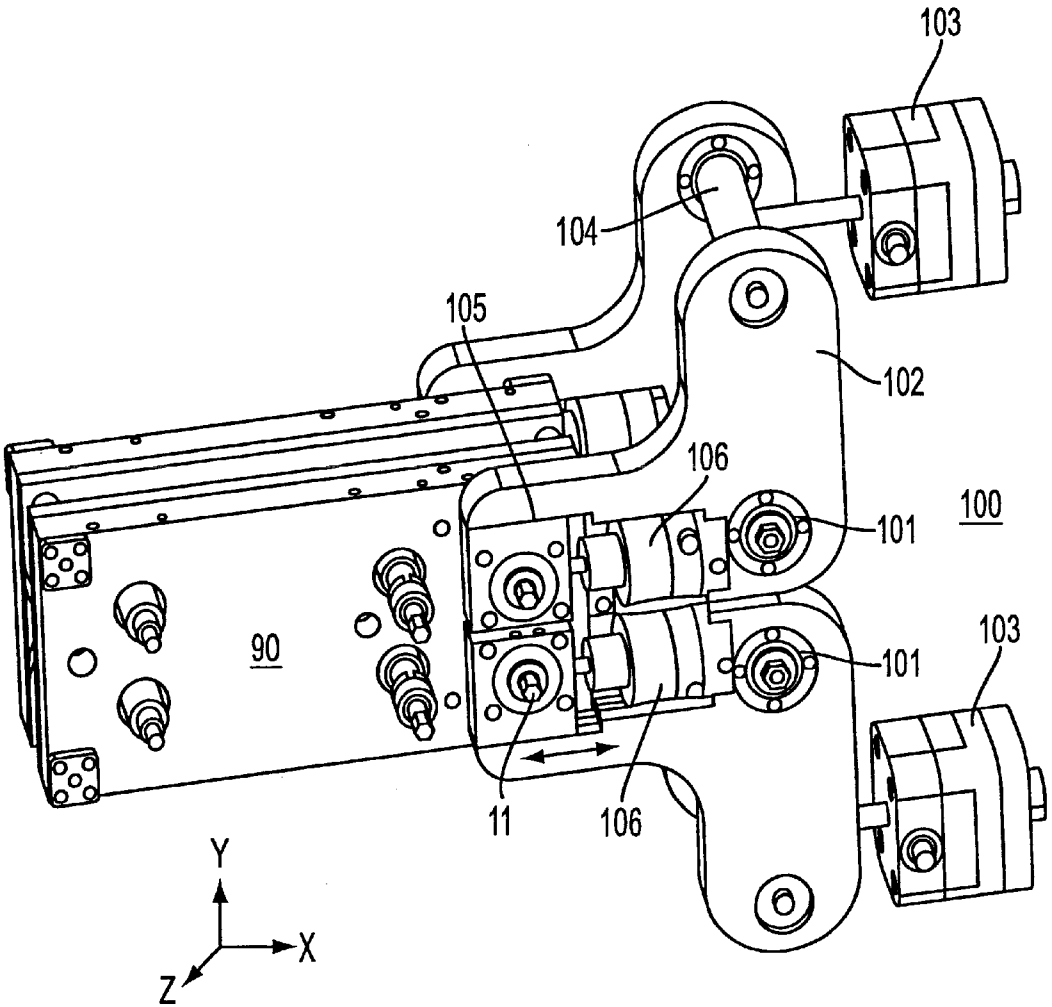
FIG. 9 is a perspective view of the crimper shown in FIGS. 2 and 3 with the loading system and the side plates attached.

The driven feed rollers 10 are biased towards one another. FIG. 8 is a perspective view of the crimper shown in FIGS. 2 and 3, with a loading system 100, but not the side plates 90 attached. FIG. 9 is a perspective view of the crimper shown in FIG. 3 with the loading system 100 and the side plates 90 attached. The loading system 100 includes a pivotal bearing 101 and loading arms 102. A shaft 11 of the driven feed rollers 10 can be seen in FIGS. 8 and 9. The shafts 11 of the driven feed rollers 10 are biased towards one another with hydraulic loading cylinders 103. The hydraulic loading cylinders 103 are attached to the loading arms 102 through transmission shafts 104. Fluid inputs to the hydraulic loading cylinders 103 selectively bias the hydraulic loading cylinders 103 in the negative x-direction, thereby forcing the driven feed rollers 10 towards one another. The transmission shaft 104 is designed to move angularly with respect to actuating rods 107. Each end of the shaft 104 is connected to the loading arms 102 on each side of the crimper using self-aligning bearings. The hydraulic loading cylinders 103 themselves are mounted to rigid frame members using pivotal bearings (FIG. 10).

The driven feed rollers 10 are also biased towards the driven belt roller 70*a*. To accomplish this, the shafts 11 of the driven feed rollers 10 are supported in linear bearings 105. Hydraulic reference cylinders 106 bias the driven feed rollers 10 in the negative x-direction. The self-aligning capability of the feed rolls in FIG. 8 can be better understood by noting that the end of each feed roller drive shaft 11 is supported in a self-aligning bearing whose inner race is free to move angularly relative to the primary axis of the bearing. This self-aligning bearing is itself mounted in a bearing block that is attached to a loading control arm with linear bearings 105. The loading control arm 102 itself is mounted with the pivotal bearing 101 to a rigid shaft, which is attached to the crimper frame. This combination of bearings allows almost infinite degrees of freedom for the feed rolls. The angular bearings not only allow the driven shaft and feed rolls to rotate, but also allow them to move angularly around the drive shaft axis. The linear bearings 105 allow movement of the drive shaft 11 and feed rolls 10 along the x-axis of the machine. The pivotal bearings 101 allow drive shaft 11 and feed roll 10 to rotate about the z-axis of the machine, while z-axis motion of the rolls is accomplished by allowing the feed rolls 10 to move axially along the feed roll drive shaft 11. A key in the drive shaft prevents rotation of the rolls relative to the drive shaft. Similar arrangements are utilized on all other rolls and shafts to provide self-alignment of all crimper parts.

Figure 10:
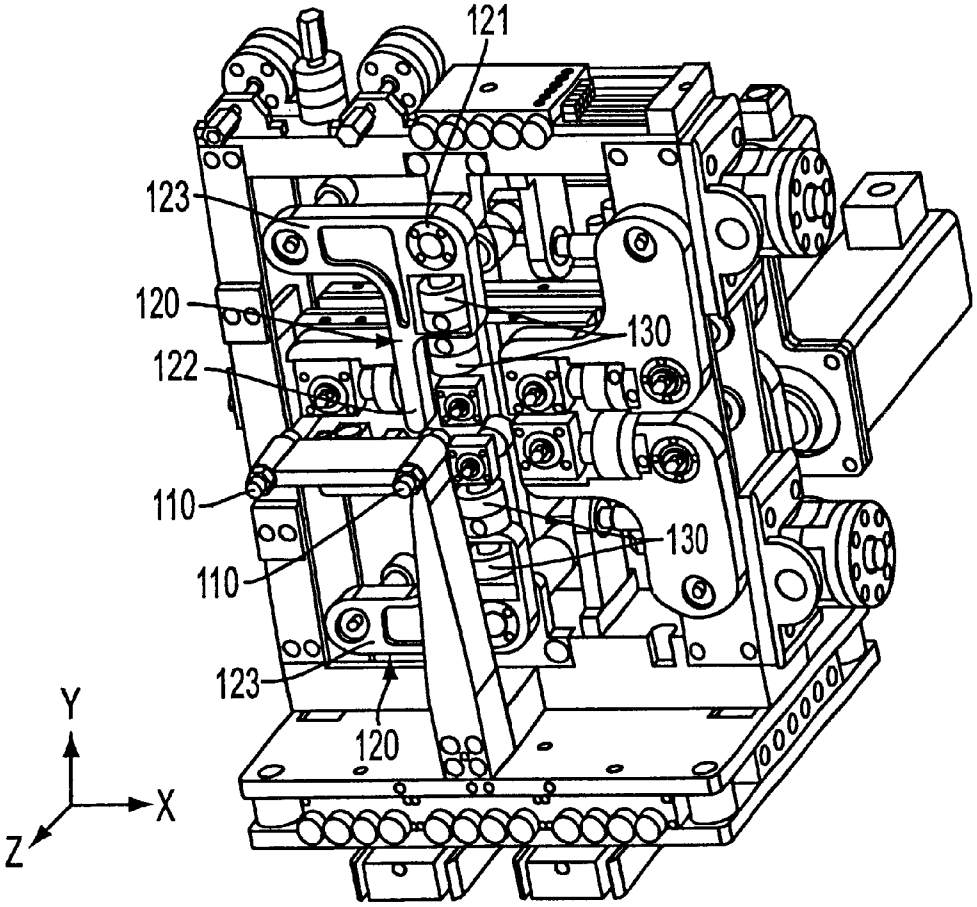
FIG. 10 is a perspective view of the crimper mechanism shown in FIGS. 2 and 3, as assembled.

FIG. 10 is a perspective view of the crimper mechanism shown in FIG. 3, as assembled. FIG. 10 shows the alignment pins 110 that extend into the holes 97*b* (see FIG. 7) in the metal portions 91 of the side plates 90. As mentioned previously, the alignment pins 110 bias the side plates 90 toward one another. FIG. 10 also shows how the driven belt rollers 70*a* are biased toward the driven feed rollers 10. Specifically, a pair of arms 120 are provided on either side of the crimper. The arms 120 rotate about pivotal bearings 121 to move the inner ends 122 of the arms 120 in the positive x-direction. The outer ends 123 of the arms 120 are biased toward one another.

The chamber tapers as mentioned above. How much the chamber opens from the inlet to the outlet is adjusted by moving the driven belt rollers 70*a* toward or apart from one another. Referring to FIG. 3, the scraper 30 is supported only by the surrounding components. Accordingly, when the driven belt rollers 70*a* are moved apart from one another, the scrapers 30 rotate about the axes of the driven feed rollers 10. Because the bottom sides 34 of the scrapers 30 define the chamber, moving the driven belt rollers 70*a* apart from one another opens the chamber and increases the taper. FIG. 10 shows the diaphragms 130 responsible for the position of the driven belt roller 70*a*. For each driven belt roller 70*a* there are four diaphragms. The crimper has two driven belt rollers. Thus, there is a total of eight diaphragms 130. The diaphragms 130 shown adjacent to the respective driven belt rollers 70*a* are pressurized with air to serve as an air spring that forces driven belt rollers 70*a* toward one another. The bearings 130 displaced from the respective driven belt rollers 70*a* are selectively supplied with hydraulic fluid. These displaced bearings 130 oppose the force of the adjacent bearings 130 and force the driven belt rollers 70*a* apart from one another. Unlike the conventional device, where the taper was fixed, the taper in the inventive device can be easily adjusted by controlling the hydraulic fluid pressure in the displaced diaphragms 130.

As discussed in detail in above, there are numerous mechanisms for controlling the positions of the rollers 10, 70*a* and 70*b*. It is important that the rollers be correctly aligned. For example, if one side of a roller is biased more than the other side of the roller, the roller would be crooked. This would create problems such as an uneven fit with side plates 90 resulting in a possible loss of one or more bearing seals. The present invention allows each roller to be self aligning. To accomplish this, fluid (liquid or gas) pressure in diaphragms positioned at opposite ends of a roller is equalized. That is, the diaphragms positioned at opposite ends of a roller are in fluid communication. For example, referring to FIG. 10, the displaced diaphragm 130 shown at the top of the drawing has a counterpart displaced diaphragm 130 (not shown) on the opposite side of the upper driven belt roller 70*a*. These two diaphragms 130 are in fluid communication, and together force the upper driven belt roller 70*a* toward the lower driven belt roller 70*a*. Fluid is pumped through a single supply to a junction, from which junction it is branched off to the two upper displaced diaphragms 130. A similar system is provided for the two lower displaced diaphragms 130. In this manner, it is impossible to bias one side of a driven belt roller 70*a* more than the other side. The pressure is equalized, and the side showing less resistence is moved more. A similar, but slightly different system exists for the four hydraulic reference cylinders 106 shown in FIG. 8. The two upper hydraulic reference cylinders 106 are in fluid communication, and the two lower hydraulic reference cylinders 106 are in fluid communication. When the crimper is assembled, the top and bottom hydraulic reference cylinders 106 are charged with fluid to thereby select position of the driven feed rollers 10. Once charged, the fluid supply is removed. However, because the top hydraulic reference cylinders 106 remain in fluid communication (as do the bottom hydraulic reference cylinders 106), equalized forces are applied to the driven feed rollers 10 in the negative X direction.

While the invention has been described in connection with the preferred embodiments and examples, it will be understood that modifications within the principles outlined above will be evident to those skilled in the art. Thus, the invention is not limited to the preferred embodiments and examples, but is intended to encompass such modifications.

What is claimed is:

1. A fiber crimping device, comprising:

a pair of feed rollers to supply fiber traveling therebetween, the feed rollers rotating at a first speed;

a pair of outlet rollers to receive fiber from the feed rollers, the outlet rollers rotating at a second speed slower than the first speed;

a pair of side walls sandwiching the feed rollers and the outlet rollers; and a pair of floating scrapers supported by and moving with the feed rollers, the outlet rollers and the side walls.

2. A fiber crimping device according to claim 1, wherein there are two pairs of outlet rollers with a belt rotating about each pair of outlet rollers.

3. A fiber crimping device according to claim 2, wherein:

for each pair of outlet rollers, a first of the outlet rollers is adjacent to the scraper and a second of the outlet rollers is displaced from the scraper, a space between the scrapers defines a crimping chamber, and the device further comprises a positioning unit to move the first outlet rollers toward and away from one another, thereby causing the crimping chamber to open and close.

4. A fiber crimping device according to claim 3, wherein the positioning unit selectively supplies fluid to opposite ends of the first outlet rollers, the pressure of the fluid supplied to the opposite ends being equalized.

5. A fiber crimping device according to claim 2, wherein:

for each pair of outlet rollers, a first of the outlet rollers is adjacent to the scraper and a second of the outlet rollers is displaced from the scraper, and the device further comprises an outlet roller hydraulic positioning system to bias the first outlet rollers toward one another and toward the scrapers via pressure equalized fluid streams such that for each first outlet roller, the biasing forces applied to opposite ends of the first outlet roller are equalized.

6. A fiber crimping device according to claim 1, wherein fluid is supplied to and ejected from the scrapers such that a fluid bearing is created at least between the scrapers and the feed rollers.

7. A fiber crimping device according to claim 1, wherein fluid is supplied to and ejected from the sidewalls.

8. A fiber crimping device according to claim 1, further comprising a hydraulic biasing system to bias the feed rollers toward one another and toward the scrapers via pressure equalized fluid streams such that for each feed roller, the biasing forces applied to opposite ends of the feed roller are equalized.

9. A fiber crimping device, comprising:

a pair of feed rollers to supply fiber traveling therebetween, the feed rollers rotating at a first speed;

a pair of outlet rollers to receive fiber from the feed rollers, the outlet rollers rotating at a second speed slower than the first speed;

a pair of scrapers, each having a front side surface fitting closely adjacent to one of the feed rollers; and a fluid ejector to eject fluid from at least the front side surfaces of the scrapers to create a fluid bearing between the feed rollers and the scrapers.

10. A fiber crimping device according to claim 9, wherein there are two pairs of outlet rollers with a belt rotating about each pair of outlet rollers.

11. A fiber crimping device according to claim 10, wherein each scraper has a back side facing one of the belts, the fluid ejector also ejecting fluid from the back sides of the scrapers.

12. A fiber crimping device according to claim 11, wherein the scrapers have opposing bottom sides facing one another, top sides opposite to the bottom sides, upper ports provided in the top sides to receive fluid, and center channels to guide fluid from the upper ports to the front and back sides.

13. A fiber crimping device according to claim 10, wherein:

for each pair of outlet rollers, a first of the outlet rollers is adjacent to the scraper and a second of the outlet rollers is displaced from the scraper, a space between the scrapers defines a crimping chamber, and the device further comprises a positioning unit to move the first outlet rollers toward and away from one another, thereby causing the crimping chamber to open and close.

14. A fiber crimping device according to claim 10, wherein:

for each pair of outlet rollers, a first of the outlet rollers is adjacent to the scraper and a second of the outlet rollers is displaced from the scraper, and the device further comprises an outlet roller hydraulic positioning system to bias the first outlet rollers toward one another and toward the scrapers via pressure equalized fluid streams such that for each first outlet roller, the biasing forces applied to opposite ends of the first outlet roller are equalized.

15. A fiber crimping device according to claim 9, further comprising a hydraulic biasing system to bias the feed rollers toward one another and toward the scrapers via pressure equalized fluid streams such that for each feed roller, the biasing forces applied to opposite ends of the feed roller are equalized.

16. A fiber crimping device, comprising:

a pair of feed rollers to supply fiber traveling therebetween, the feed rollers rotating at a first speed;

a pair of belts each rotating at a second speed slower than the first speed, to receive fiber from the feed rollers, each belt rotating about first and second outlet rollers, a pair of scrapers, each fitting between and supported by one of the feed rollers and one of the belts, such that the first outlet rollers are adjacent to the scrapers and the second outlet rollers are displaced from the scrapers, the scrapers having bottom surfaces opposing each other to define a crimping chamber therebetween; and a positioning unit to move the first outlet rollers toward and away from one another, thereby causing the crimping chamber to open and close.

17. A fiber crimping device according to claim 16, wherein:

the feed rollers rotate about axes of rotation, and moving the first outlet rollers toward and away from one another causes the scrapers to rotate about the axes of rotation of the feed rollers.

18. A fiber crimping device, comprising:

means for supplying fiber through a nip between a pair of feed rollers rotating at a first speed;

means for receiving fiber from the feed rollers with a pair of outlet rollers rotating at a second speed slower than the first speed;

means for crimping the fiber between the feed rollers and the outlet rollers in a crimping chamber defined by a pair of scrapers, each scraper having a front side surface fitting closely adjacent to one of the feed rollers; and means for ejecting fluid from at least the front side surfaces of the scrapers to create a fluid bearing between the feed rollers and the scrapers.

19. A fiber crimping method, comprising the steps of:

supplying fiber through a nip between a pair of feed rollers rotating at a first speed;

receiving fiber from the feed rollers with a pair of outlet rollers rotating at a second speed slower than the first speed;

crimping the fiber between the feed rollers and the outlet rollers in a crimping chamber defined by a pair of scrapers, each scraper having a front side surface fitting closely adjacent to one of the feed rollers; and ejecting fluid from at least the front side surfaces of the scrapers to create a fluid bearing between the feed rollers and the scrapers.

20. A fiber crimping method according to claim 19, wherein there are two pairs of outlet rollers with a belt rotating about each pair of outlet rollers.

21. A fiber crimping method according to claim 20, wherein each scraper has a back side facing one of the belts, with fluid also being ejected from the back sides of the scrapers.

22. A fiber crimping method according to claim 21, wherein:

for each pair of outlet rollers, a first of the outlet rollers is adjacent to the scraper and a second of the outlet rollers is displaced from the scraper, a space between the scrapers defines a crimping chamber, and the method further comprising the step of moving the first outlet rollers toward and away from one another, thereby causing the crimping chamber to open and close.

23. A fiber crimping method according to claim 20, wherein:

for each pair of outlet rollers, a first of the outlet rollers is adjacent to the scraper and a second of the outlet rollers is displaced from the scraper, and the method further comprising the step of biasing the first outlet rollers toward one another and toward the scrapers via pressure equalized fluid streams such that for each first outlet roller, the biasing forces applied to opposite ends of the first outlet roller are equalized.

24. A fiber crimping method according to claim 19, further comprising the step of biasing the feed rollers toward one another and toward the scrapers via pressure equalized fluid streams such that for each feed roller, the biasing forces applied to opposite ends of the feed roller are equalized.

25. A crimped fiber produced by a process comprising the steps of:

supplying fiber through a nip between a pair of feed rollers rotating at a first speed;

receiving fiber from the feed rollers with a pair of outlet rollers rotating at a second speed slower than the first speed;

crimping the fiber between the feed rollers and the outlet rollers in a crimping chamber defined by a pair of scrapers, each scraper having a front side surface fitting closely adjacent to one of the feed rollers; and ejecting fluid from at least the front side surfaces of the scrapers to create a fluid bearing between the feed rollers and the scrapers.

26. A crimped fiber according to claim 25, wherein there are two pairs of outlet rollers with a belt rotating about each pair of outlet rollers.

27. A crimped fiber according to claim 26, wherein each scraper has a back side facing one of the belts, with fluid being ejected from the front and back sides of the scrapers.

28. A crimped fiber according to claim 26, wherein:

for each pair of outlet rollers, a first of the outlet rollers is adjacent to the scraper and a second of the outlet rollers is displaced from the scraper, a space between the scrapers defines a crimping chamber, and the method further comprising the step of moving the first outlet rollers toward and away from one another, thereby causing the crimping chamber to open and close.

29. A crimped fiber according to claim 26, wherein:

for each pair of outlet rollers, a first of the outlet rollers is adjacent to the scraper and a second of the outlet rollers is displaced from the scraper, and the method further comprising the step of biasing the first outlet rollers toward one another and toward the scrapers via pressure equalized fluid streams such that for each first outlet roller, the biasing forces applied to opposite ends of the first outlet roller are equalized.

30. A crimped fiber according to claim 25, further comprising the step of biasing the feed rollers toward one another and toward the scrapers via pressure equalized fluid streams such that for each feed roller, the biasing forces applied to opposite ends of the feed roller are equalized.

31. A fiber crimping device, comprising:

a pair of feed rollers to supply fiber traveling therebetween;

a pair of belts to receive fiber therebetween from the feed rollers, each belt rotating about a pair of outlet rollers;

a pair of scrapers positioned between the feed rollers and the belts; and a self-aligning mechanism to correctly position at least one pair of the rollers about three mutually perpendicular axes.

32. A fiber crimping device according to claim 31, wherein for each pair of outlet rollers, a first of the outlet rollers is adjacent to the scraper and a second of the outlet rollers is displaced from the scraper, and the self-aligning mechanism positions at least the first outlet rollers, the self-aligning mechanism comprising:

a pair of side walls sandwiching the first outlet rollers to position the first outlet rollers along a first axis;

a pair of pivotal bearings;

two pairs arms, each arm having inner and outer ends and a central portion, the central portions of each pair of arms rotating about one of the pivotal bearings, the inner ends of each pair connecting with one of the first outlet rollers to control the position of the first outlet roller along a second axis;

a pair of biasing devices, each being connected to the outer ends of one pair of arms;

a pair of air springs, each connected to one of the first outlet rollers; and two pairs of hydraulic cylinders, each pair being connected to one of the first outlet rollers to selectively bias the first outlet roller against a force from one of the air springs, to control the position of the first outlet roller along a third axis, each pair of hydraulic cylinders being in fluid communication.

33. A fiber crimping device according to claim 31, wherein the self-aligning mechanism positions at least the feed rollers, the self-aligning mechanism comprising:

a pair of side walls sandwiching the feed rollers to position the feed rollers along a first axis;

two pairs of hydraulic reference cylinders, each pair being connected to one of the feed rollers to control the position of the feed roller along a second axis, each pair of hydraulic reference cylinders being in fluid communication;

a pair of pivotal bearings;

two pairs loading arms having first and second ends and a central portion, the central portions of each pair of loading arms rotating about one of the pivotal bearings, the first ends of each pair connecting with one of the feed rollers to control the position of the feed roller along a third axis; and a pair of hydraulic loading cylinders, each being connected to the second ends of one pair of loading arms.

* * * * *